US008522883B2

(12) United States Patent
Ringgenberg et al.

(10) Patent No.: US 8,522,883 B2
(45) Date of Patent: Sep. 3, 2013

(54) DEBRIS RESISTANT INTERNAL TUBULAR TESTING SYSTEM

(75) Inventors: Paul D. Ringgenberg, Frisco, TX (US); Cory L. Huggins, Grand Prairie, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/609,525

(22) Filed: Sep. 11, 2012

(65) Prior Publication Data

US 2013/0081806 A1 Apr. 4, 2013

(30) Foreign Application Priority Data

Oct. 4, 2011 (WO) ..... PCT/US2011/054799

(51) Int. Cl.
*E21B 34/08* (2006.01)

(52) U.S. Cl.
USPC ..... 166/373; 166/324; 166/332.3; 166/332.7

(58) Field of Classification Search
USPC ..... 166/373, 324, 332.3, 332.7
See application file for complete search history.

(56) References Cited

U.S. PATENT DOCUMENTS 1,861,722 A * 6/1932 Searle ..... 166/236
1,969,742 A * 8/1934 French ..... 251/129.2
4,076,077 A * 2/1978 Nix et al. ..... 166/374
4,694,903 A 9/1987 Ringgenberg
5,484,022 A 1/1996 Coutts et al.
5,509,480 A * 4/1996 Terrell et al. ..... 166/297
5,649,597 A 7/1997 Ringgenberg
5,890,698 A 4/1999 Domytrak
2005/0115708 A1 6/2005 Jabusch
2008/0223581 A1 9/2008 Beall et al.
2009/0126933 A1 5/2009 Telfer
2011/0079394 A1 4/2011 Plunkett et al.

OTHER PUBLICATIONS

MONEL alloy K-500, Speical Metals Corporation, Sep. 2004, pp. 1-20.*
International Search Report with Written Opinion issued May 9, 2012 for PCT Patent Application No. PCT/US11/054799, 10 pages.
Halliburton; "DynaLink Telemetry System", article H04930, dated Jan. 2010, 2 pages.
Search Report issued May 9, 2012 for International Application No. PCT/US11/54799, 5 pages.
Written Opinion issued May 9, 2012 for International Application No. PCT/US11/54799, 5 pages.

* cited by examiner

*Primary Examiner* — Giovanna Wright
(74) *Attorney, Agent, or Firm* — Smith IP Services, P.C.

(57) ABSTRACT

A tubular string testing system for use with a tubular string having a longitudinally extending flow passage can include a valve which selectively permits and prevents fluid communication between sections of the flow passage, a bypass passage which provides fluid communication between the sections of the flow passage when the valve is closed, and a filter which filters fluid that flows through the bypass passage. A method of testing a tubular string can include permitting fluid to flow through a bypass passage which connects sections of a flow passage extending longitudinally through the tubular string, a filter filtering the fluid which flows through the bypass passage, a valve of a tubular string testing system preventing flow of the fluid between the sections of the flow passage through the valve, and flow through the bypass passage being prevented in response to a predetermined pressure differential being created across the filter.

6 Claims, 13 Drawing Sheets

DEBRIS RESISTANT INTERNAL TUBULAR TESTING SYSTEM

CROSS-REFERENCE TO RELATED APPLICATION

This application claims the benefit under 35 USC §119 of the filing date of International Application Serial No. PCT/US11/54799 filed 4 Oct. 2011. The entire disclosure of this prior application is incorporated herein by this reference.

BACKGROUND

This disclosure relates generally to equipment utilized and operations performed in conjunction with a subterranean well and, in an example described below, more particularly provides a debris resistant internal tubular testing system.

It is beneficial to be able to pressure test a tubular string as it is being installed in a well. Such pressure testing can prevent time and expense being wasted retrieving the tubular string to eliminate one or more leaks. Therefore, it will be appreciated that improvements are continually needed in the art of constructing systems for testing tubular strings.

SUMMARY

In the disclosure below, a tubular string testing system and method are provided which bring improvements to the art. One example is described below in which a filter is used to prevent debris from causing malfunction of the system. Another example is described below in which the system includes a bypass passage with one or more check valves downstream of a filter.

In one aspect, this disclosure provides to the art a tubular string testing system for use with a tubular string having a flow passage extending longitudinally through the tubular string. In one example, the testing system can include a valve which selectively permits and prevents fluid communication between sections of the flow passage, a bypass passage which provides fluid communication between the sections of the flow passage when the valve is closed, and a filter which filters fluid that flows through the bypass passage.

In another aspect, a method of testing a tubular string is described below. In one example, the method can include permitting fluid to flow through a bypass passage which connects sections of a flow passage extending longitudinally through the tubular string, with a filter filtering the fluid which flows through the bypass passage. A valve of a tubular string testing system prevents flow of the fluid between the sections of the flow passage through the valve. Flow through the bypass passage is prevented in response to a predetermined pressure differential being created across the filter.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
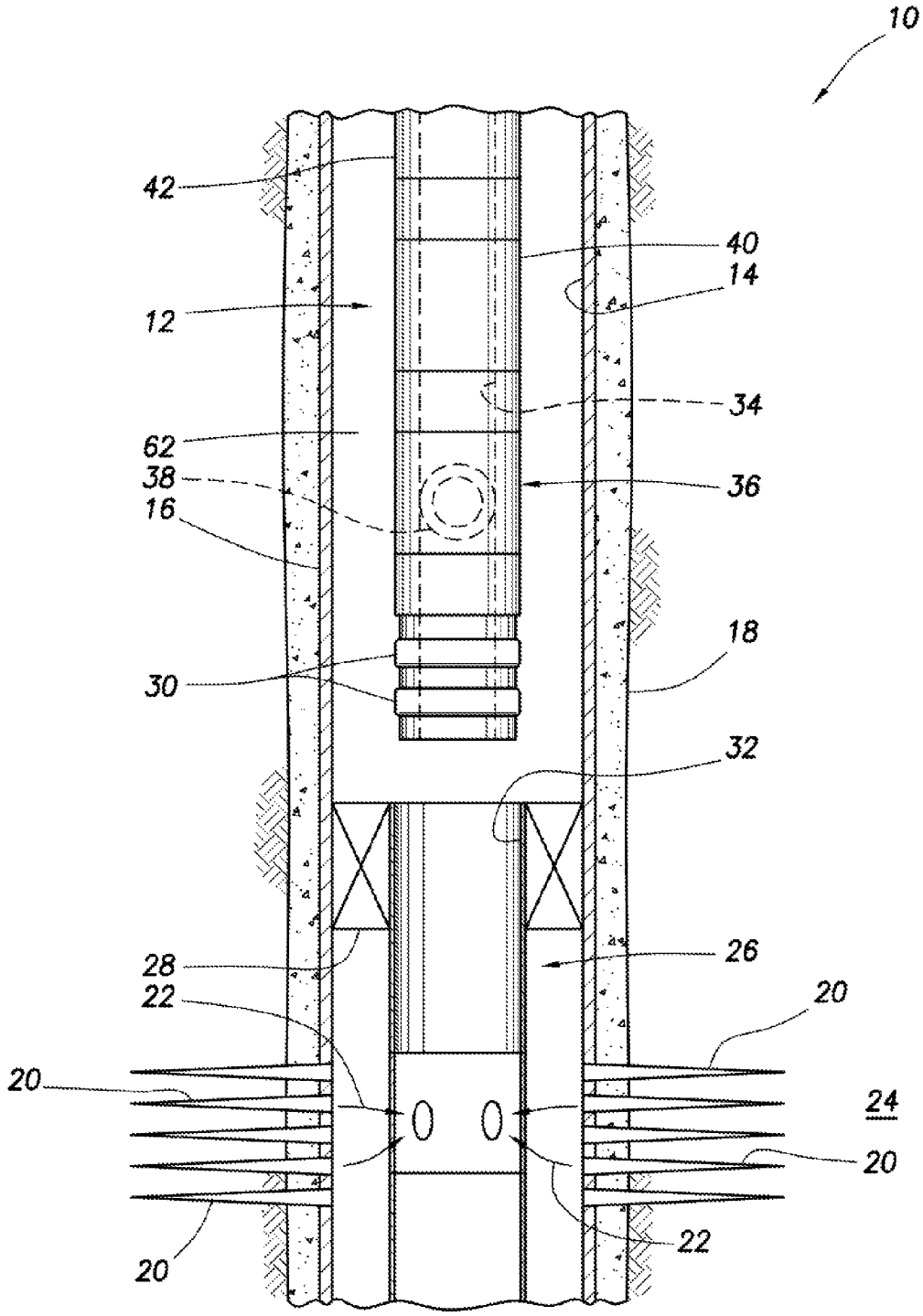
FIG. 1 is a representative partially cross-sectional view of a well system and associated method which can embody principles of this disclosure.

Representatively illustrated in FIG. 1 is a system 10 and associated method for use with a well. The well system 10 and method can embody principles of this disclosure, but it should be clearly understood that the system and method are merely one example of a wide variety of systems and methods which can be respectively constructed and performed within the scope of this disclosure.

In the FIG. 1 example, a tubular string 12 is conveyed into a wellbore 14. The wellbore 14 may be lined with casing 16 and cement 18, with perforations 20 to allow fluid 22 to flow from an earth formation 24 penetrated by the wellbore into a generally tubular completion string 26 for production to the surface.

In other examples, the wellbore 14 may not be lined with casing 16 and cement 18 where the fluid 22 flows into the wellbore (e.g., the wellbore could be uncased or open hole, for example, below a packer 28 which seals and secures the completion string 26 in the wellbore), the wellbore could be horizontal or inclined, the packer could comprise a liner hanger, the completion string, perforating guns (not shown) and the tubular string 12 could be conveyed into the wellbore in a single trip, as parts of a single tubular string, etc. Thus, it will be appreciated that many changes can be made to the well system 10 and method depicted in FIG. 1, while still remaining within the scope of this disclosure.

The tubular string 12 may be of the type known to those skilled in the art as a work string, and may be comprised of tubular segments and/or continuous tubing, etc. Any types of tubular materials may be used for the tubular string, including (but not limited to) tubulars known to those skilled in the art as production tubing, coiled tubing, composite tubing, wired tubing, etc.

The FIG. 1 tubular string 12 has seals 30 on a lower end thereof for sealing within a seal bore 32 of the packer 28 (or in a seal bore extension connected to a liner hanger, etc.). In this manner, a flow passage 34 extending longitudinally through the tubular string 12 will be placed in sealed fluid communication with the interior of the completion string 26, so that the fluid 22 can flow through the passage 34, for example, during testing of the formation 24.

Interconnected in the tubular string 12 is a tubular string testing system 36. In this example, the testing system 36 allows the tubular string 12 to fill with well fluid as it is being lowered into the wellbore 14.

Furthermore, the testing system 36 allows increased pressure to be applied to the flow passage 34 above a valve 38, in order to internally pressure test the tubular string 12. The tubular string 12 can be periodically pressure tested as it is being lowered into the wellbore 14, and installation can resume if each pressure test is successful.

The tubular string 12 can also have a tester valve 40 and a circulating valve 42 interconnected therein for use in testing the formation 24 (for example, in pressure buildup and drawdown tests), for establishing circulation through the tubular string after the tests, etc. Suitable tester valves for use in the tubular string 12 include LPR-N™ and SELECT™ tester valves marketed by Halliburton Energy Services, Inc. of Houston, Tex. USA, and suitable circulating valves include OMNI™, RTTS™ and VIPR™ circulating valves, also marketed by Halliburton Energy Services, Inc. Of course, other types of tester and circulating valves may be used, and the use of tester and circulating valves is not necessary, in keeping with the scope of this disclosure.

The valve 38 in the testing system 36 prevents flow through the passage 34 so that, during the tubular string 12 pressure tests, the increased pressure applied above the valve does not leak out of the lower end of the tubular string. However, to allow the tubular string 12 to fill with well fluid as it is being lowered into the wellbore 14, a bypass passage is provided around the valve 38. One example of a testing system 36 with such a valve 38 and a bypass passage 44 is representatively illustrated in FIGS. 2A-F.

The testing system 36 depicted in FIGS. 2A-F may be used in the well system 10 and method of FIG. 1, and the testing system is further described herein as if the testing system is used in the FIG. 1 well system and method examples. However, it should be clearly understood that the testing system 36 may be used in other well systems and methods, while remaining within the scope of this disclosure.

While the tubular string 12 is being installed in the wellbore 14, the valve 38 of the testing system 36 is closed (see FIG. 2B), so that increased pressure can be applied to a section 34*a* of the flow passage 34 above the valve. However, the bypass passage 44 (see FIGS. 2B-D) allows well fluid 46 to flow around the valve 38, even though the valve is closed, as the tubular string 12 is being lowered into the wellbore 14.

In the example depicted in FIGS. 2A-F, the valve 38 comprises a ball valve 48 and an actuator 50. The actuator 50 includes a piston 52 reciprocably received in a housing assembly 54.

The piston 52 separates two gas chambers 56, 58, both of which are initially at substantially the same pressure (for example, atmospheric pressure). Gas in the chambers 56, 58 could be air or an inert gas, such as nitrogen, etc.

A rupture disk 60 initially isolates the chamber 58 from pressure exterior to the testing system 36. If the testing system 36 is used in the system 10, this pressure would be in an annulus 62 formed radially between the tubular string 12 and the wellbore 14.

Figure 2A:
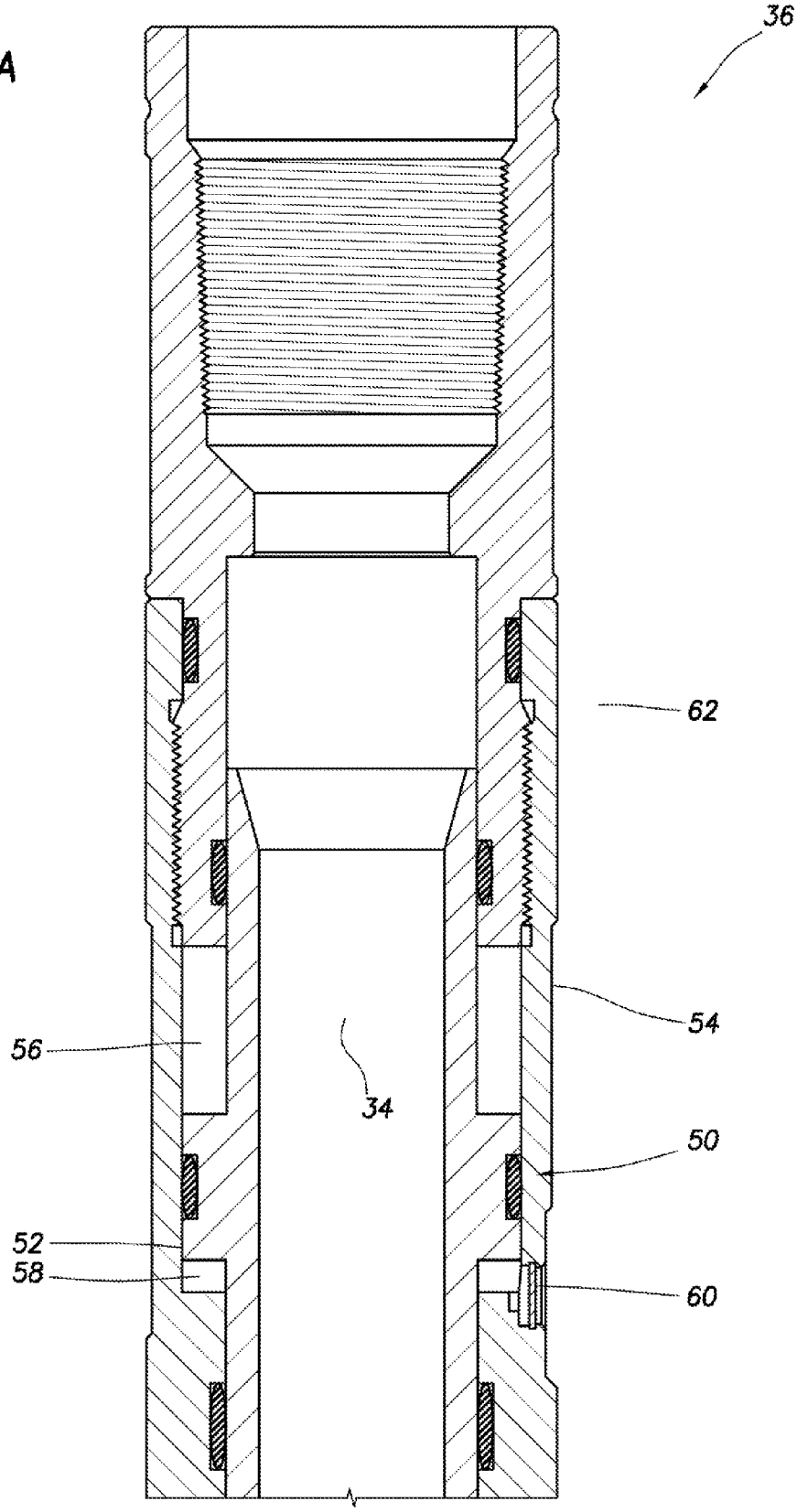
FIGS. 2A-F are a series of representative cross-sectional views of a tubular string testing system which can embody principles of this disclosure, the testing system being depicted in a run-in configuration.
Figure 2B:
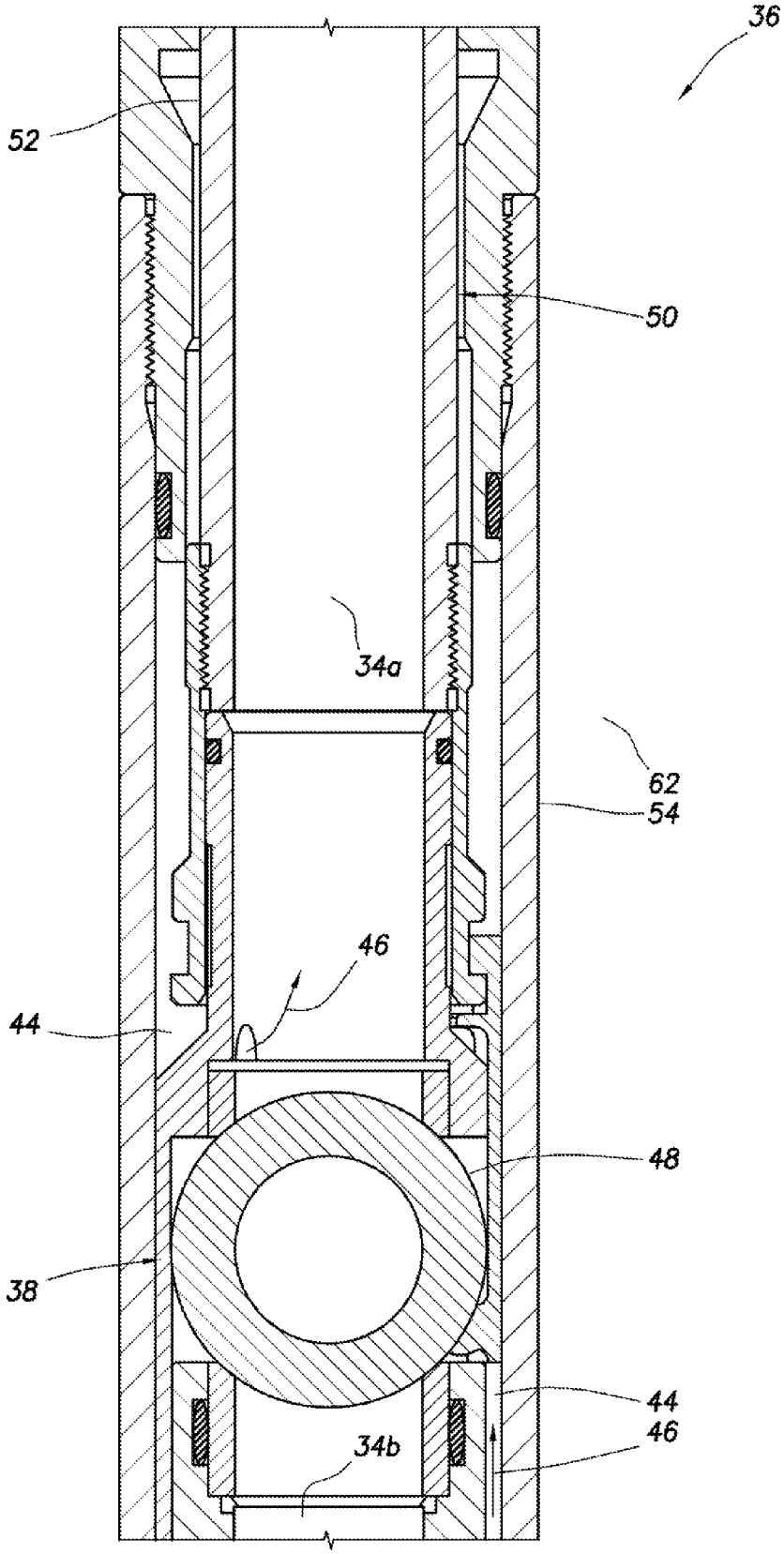
Figure 3A:
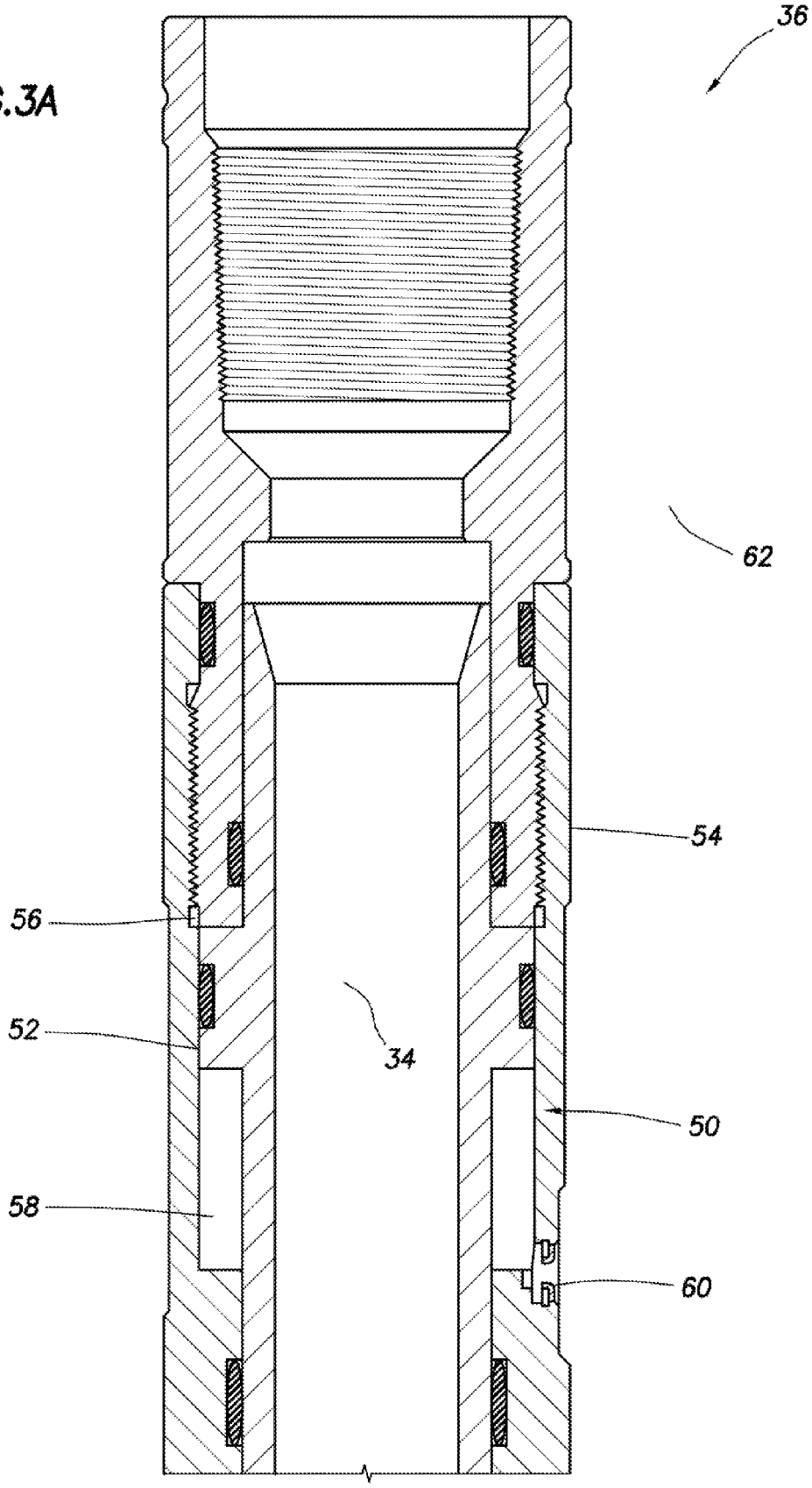
FIGS. 3A-F are a series of representative cross-sectional views of the testing system in one possible actuated configuration.
Figure 3B:
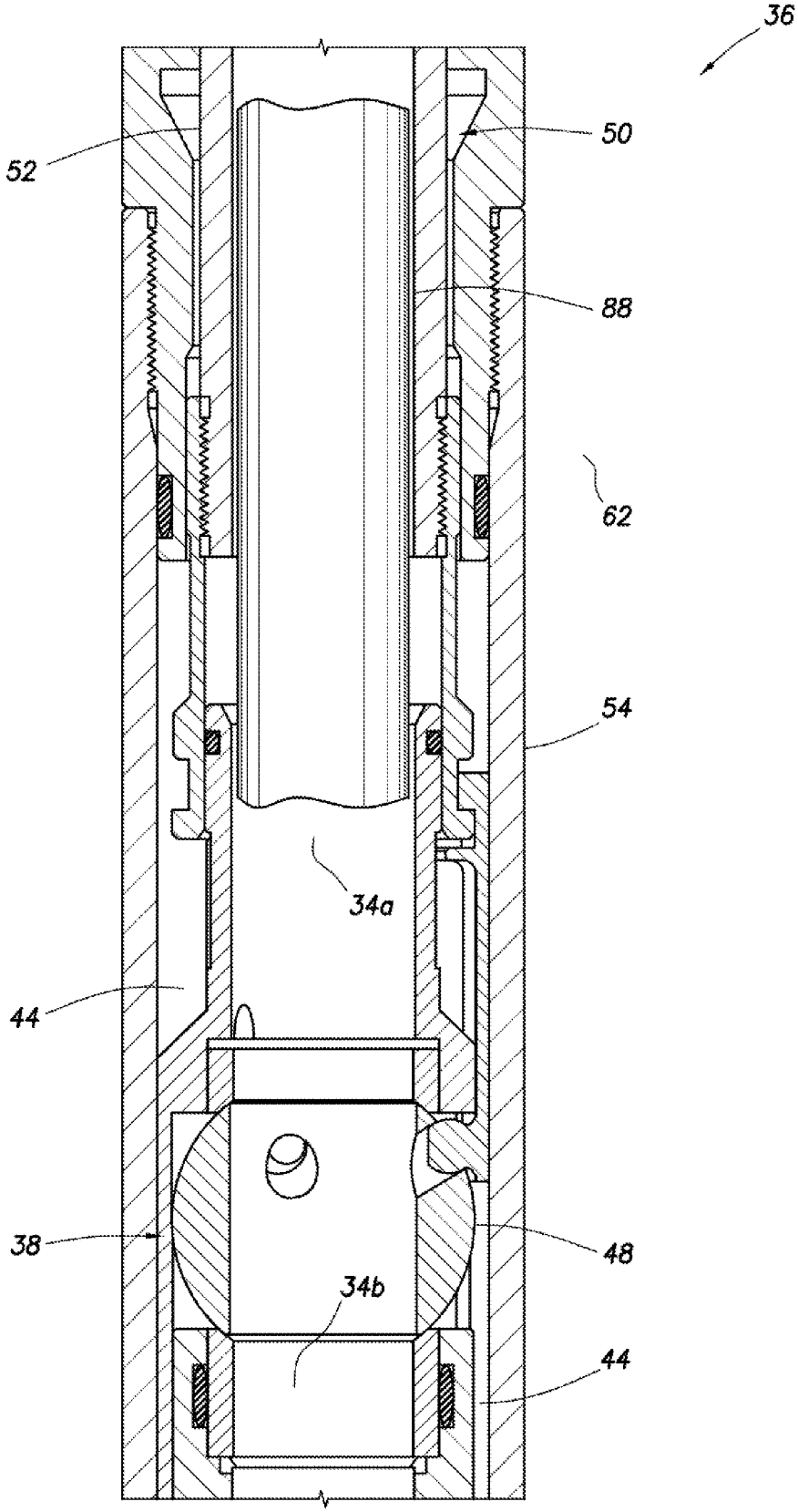
Figure 3C:
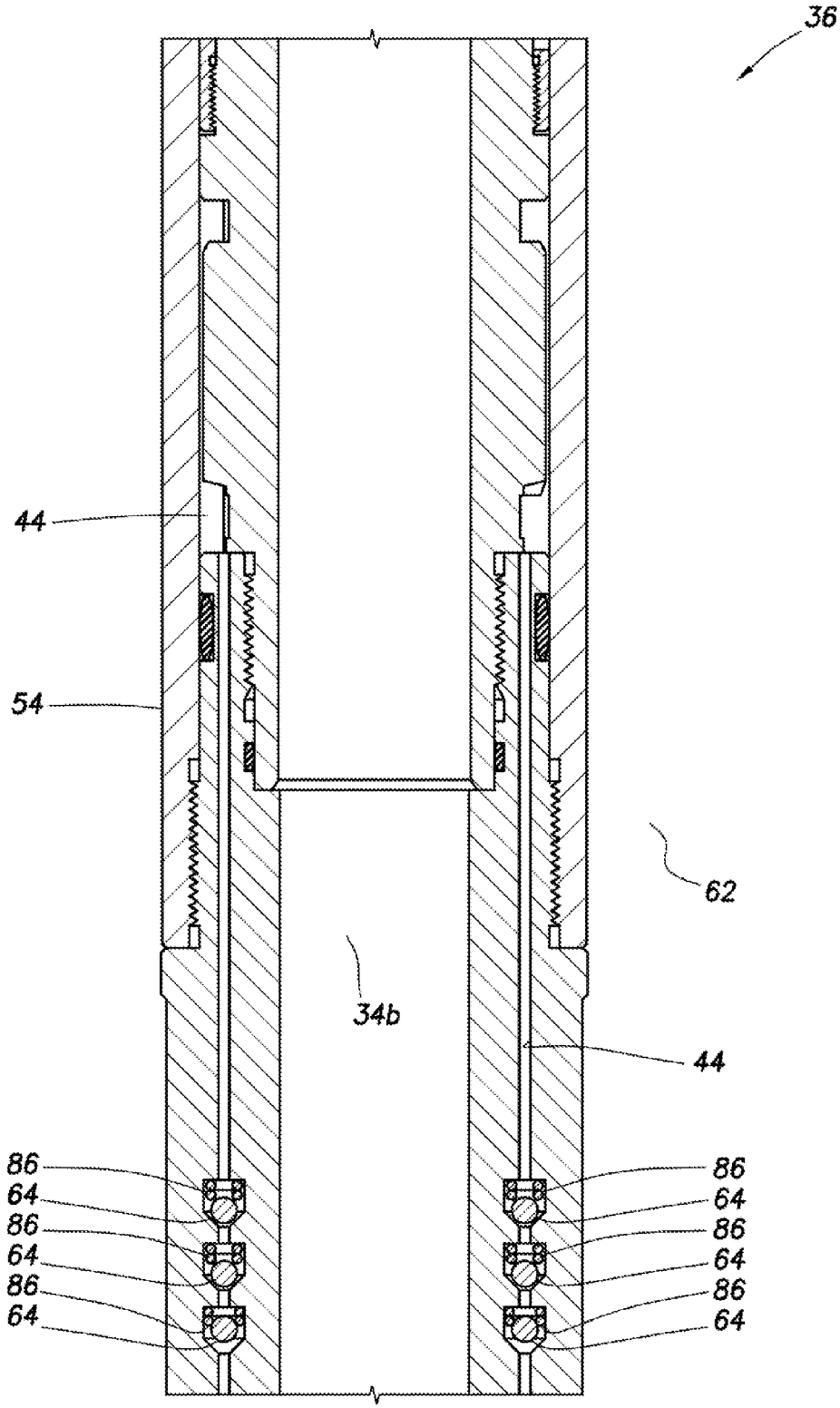

To actuate the valve 38 from its closed configuration (as depicted in FIG. 2B) to its open configuration (as depicted in FIG. 3B), pressure in the annulus 62 can be increased to a predetermined level, thereby rupturing the disk 60 and admitting the annulus pressure to the chamber 58. This will create a pressure differential from the chamber 58 to the chamber 56, thereby biasing the piston 52 to displace upward (as viewed in the figures) and actuate the valve 38 to its open configuration.

Instead of the rupture disk 60, other means of temporarily isolating the chamber 58 (such as, a valve, etc.), or other means of releasably securing the piston 52 against displacement (such as, shear pins, etc.) may be used, in keeping with the scope of this disclosure. In one example, one or more valves or other flow control devices could be remotely operated, such as from at or near the earth's surface, via telemetry (e.g., the DYNALINK™ acoustic telemetry system marketed by Halliburton Energy Services, Inc.).

Preferably, the valve 38 is not actuated from its closed configuration to its open configuration, until the tubular string 12 is fully installed, or at least until there is no longer a need to pressure test the tubular string. However, the valve 38 may be actuated at any time, in keeping with the scope of this disclosure.

Figure 2C:
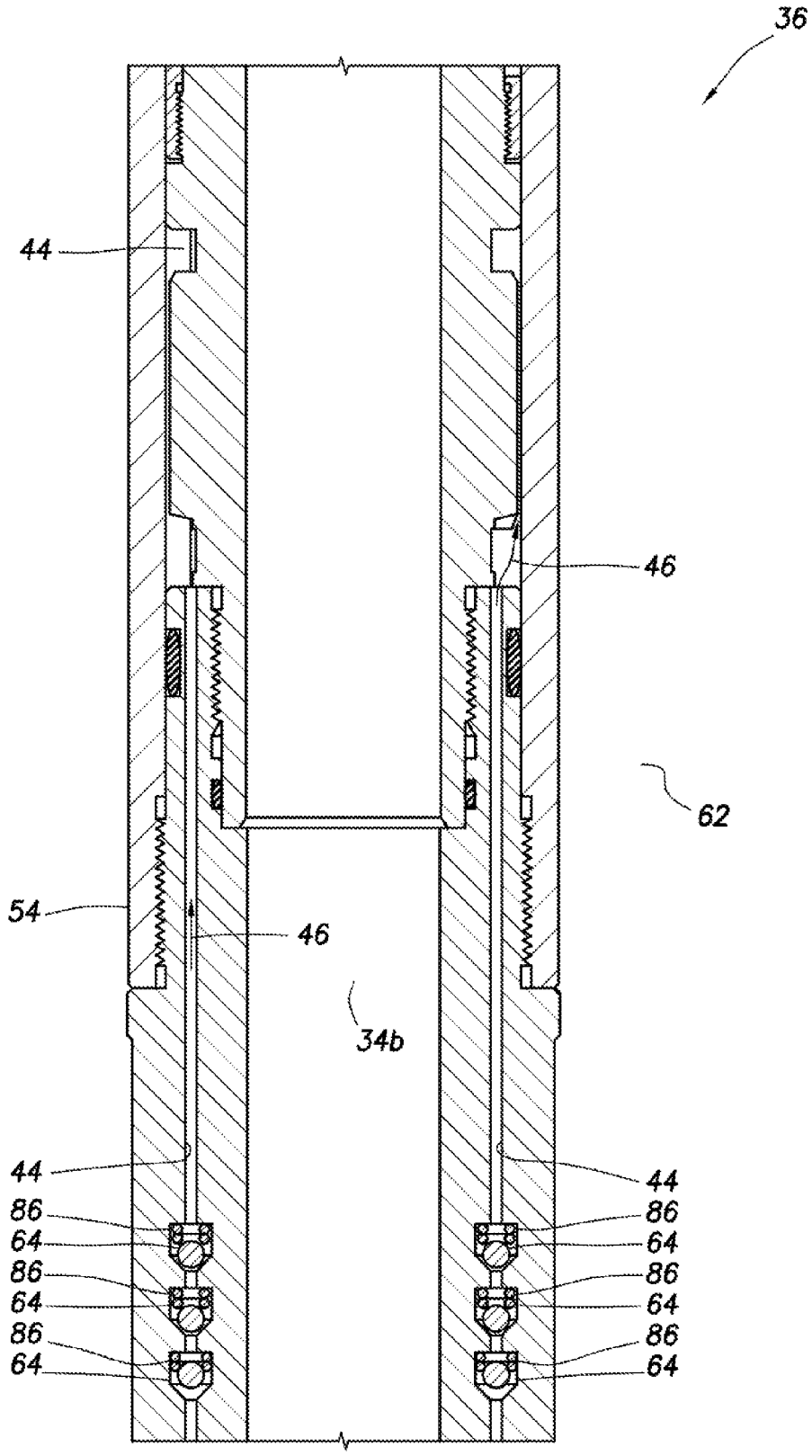

As depicted in FIG. 2C, multiple check valves 64 are connected in series in each of multiple bypass passages 44 extending longitudinally through the housing assembly 54. However, in other examples, a single bypass passage 44 and a single check valve 64 could be used, if desired.

The check valves 64 allow the fluid 46 to flow from the passage section 34*b* to the passage section 34*a*, even though the valve 38 prevents such flow through the valve itself. Thus, the tubular string 12 can be filled with the fluid 46 as the tubular string is being installed, with the valve 38 in its closed configuration.

The use of multiple check valves 64 allows one (or more) of the check valves to fail, while other(s) of the check valves can continue to prevent reverse flow of fluid 46 from the passage section 34*a* to the passage section 34*b* (for example, during a pressure test of the tubular string 12). The check valves 64 could fail, for example, due to debris preventing sealing engagement with seats in the check valves.

Figure 2D:
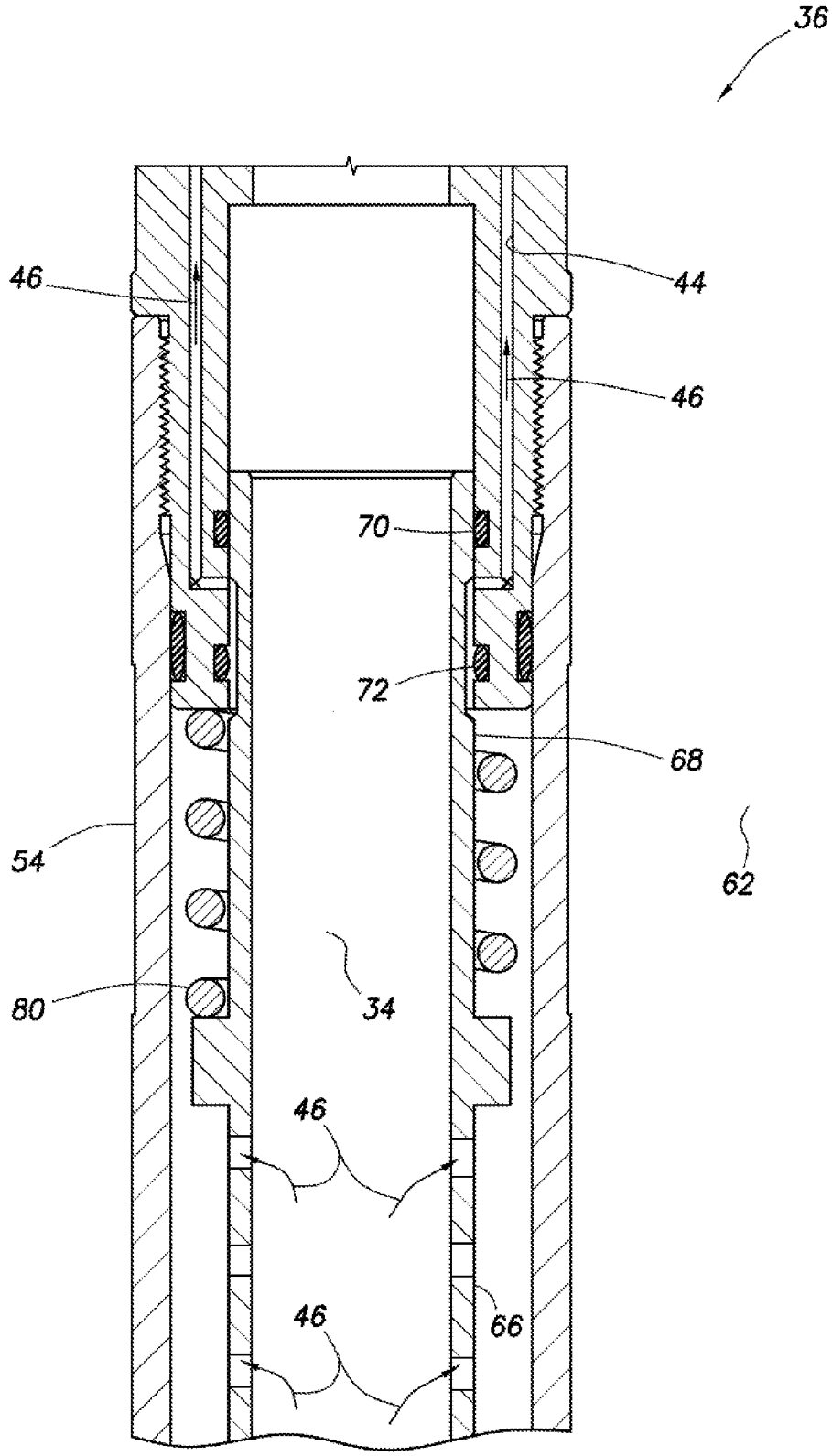

To prevent debris from clogging the bypass passages 44, or causing the ball valve 48 or check valves 64 to malfunction, etc., a filter 66 is used to filter the fluid 46 as it enters the bypass passages (see FIG. 2D). The filter 66 could, for example, be a wire mesh, sintered, wire wrapped, or other type of filter. Note that, in this example, the filter 66 is incorporated into a longitudinal section of a mandrel 68, an outer surface of which can be sealingly engaged by seals 70, 72 which straddle the bypass passages 44.

Figure 3D:
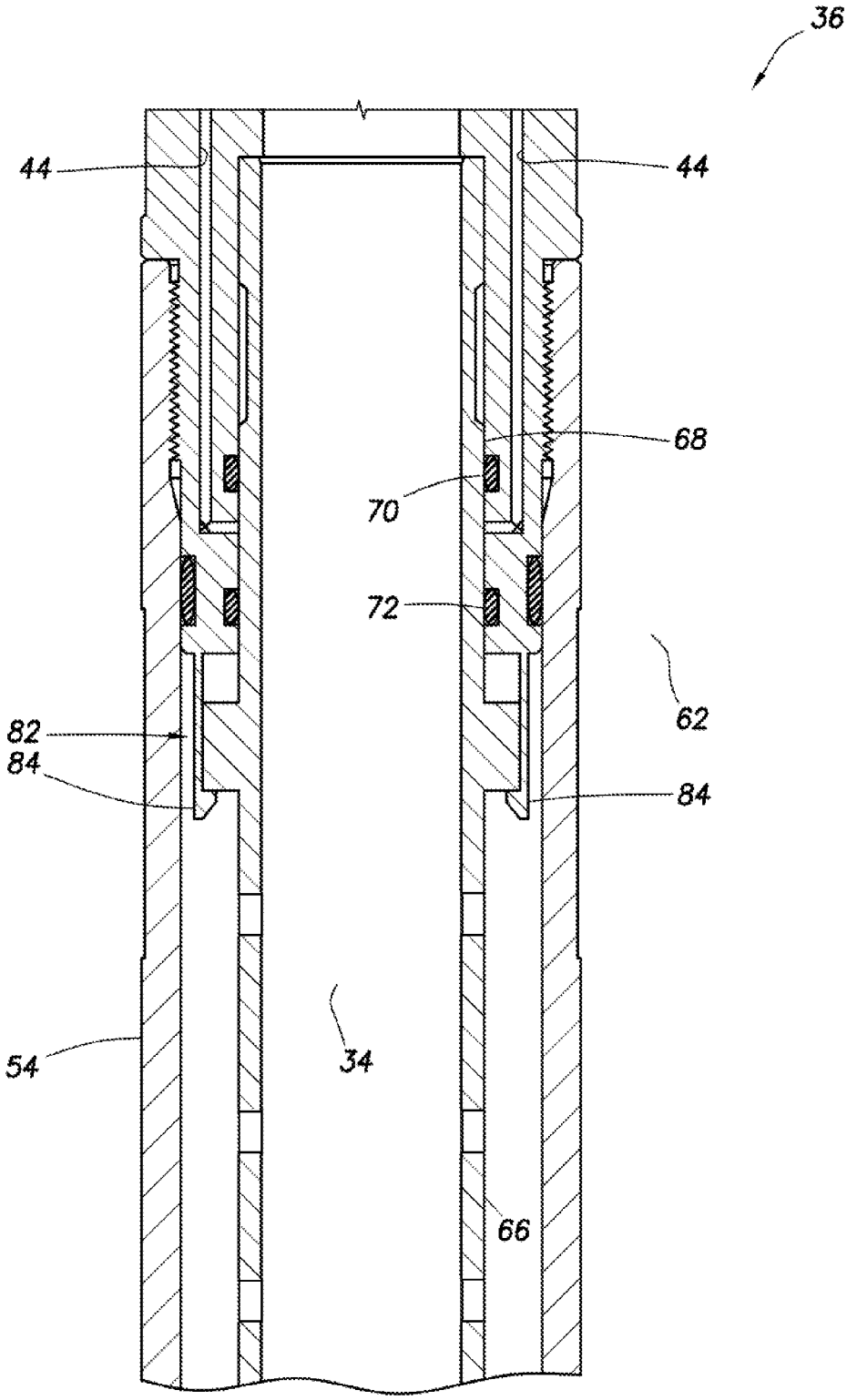
Figure 3E:
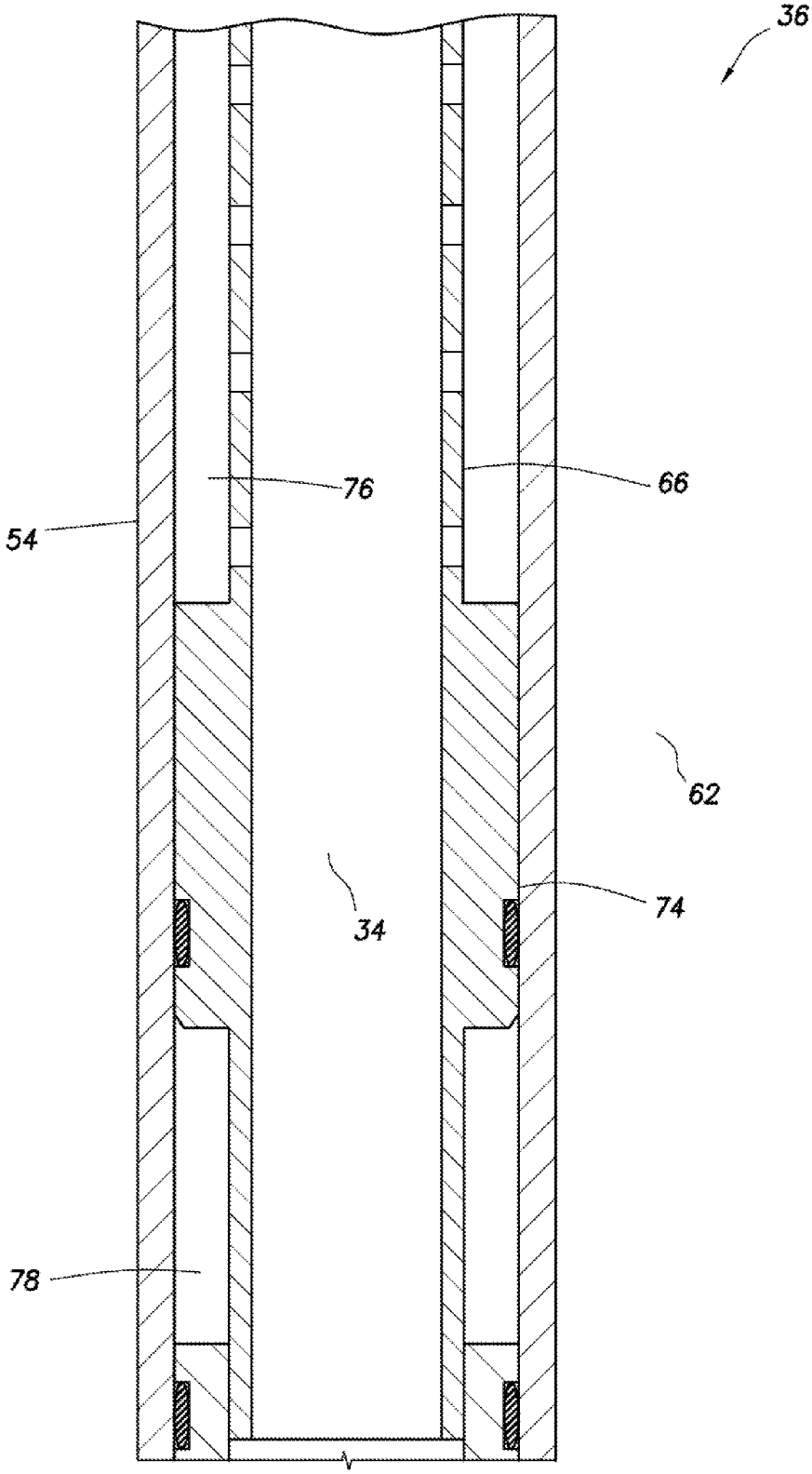
Figure 3F:
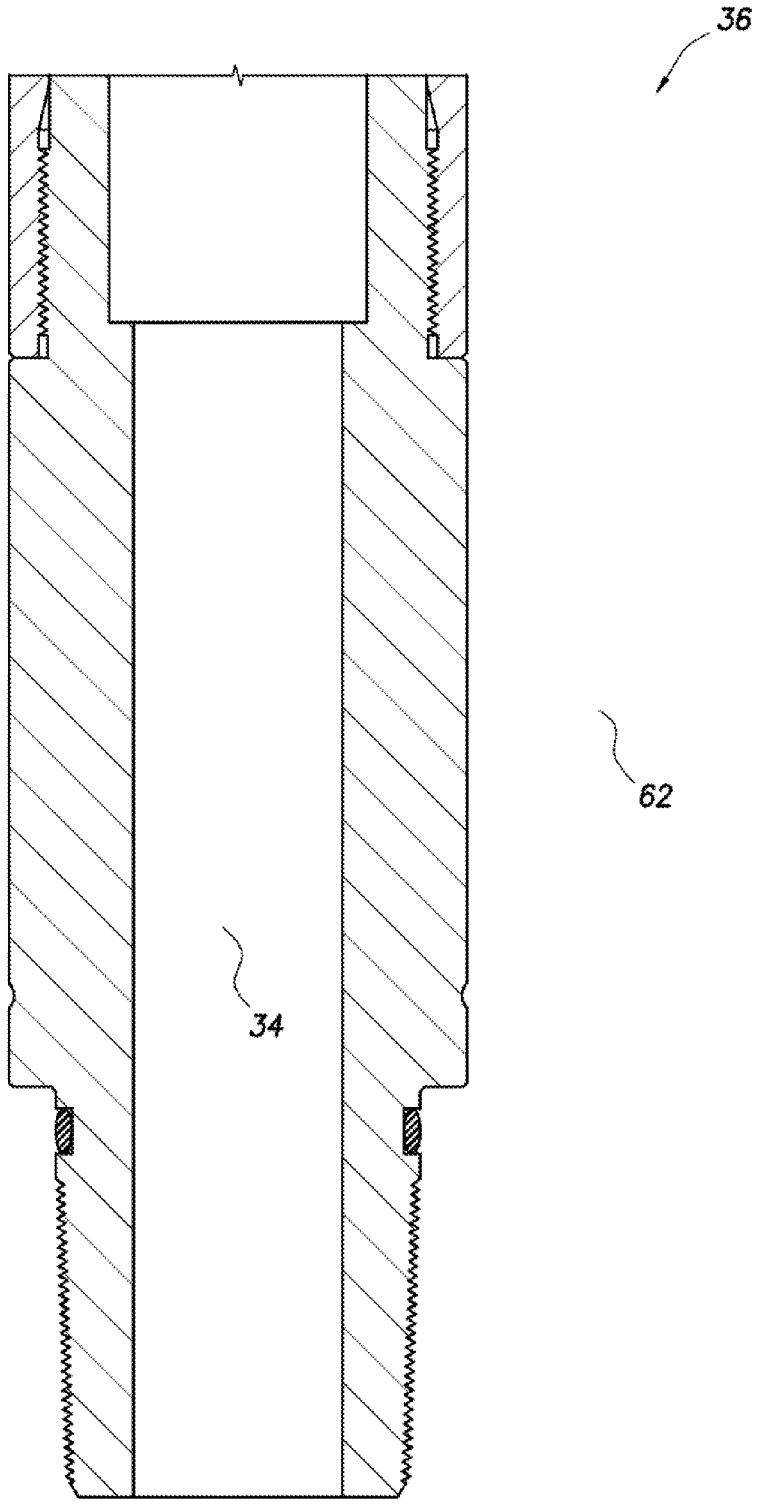

As depicted in FIG. 2D, an upper end of the mandrel 68 is sealingly engaged with the seal 70, so that fluid 46 which flows from the passage 34 to the bypass passage 44 must flow through the filter 66. If the mandrel 68 is displaced upward, however, the filter 66 will also displace upward, and the seals 70, 72 will both sealingly engage a blank portion of the mandrel, thereby preventing fluid 46 from flowing into the bypass passage (as depicted in FIG. 3D).

The mandrel 68 displaces upward if the filter 66 becomes unacceptably clogged with debris, so that the fluid 46 can no longer adequately flow through the bypass passages 44. A pressure differential will be created across the filter 66 due to the restriction to flow through the filter, and this pressure differential can be used to displace the filter, as described more fully below.

Figure 2E:
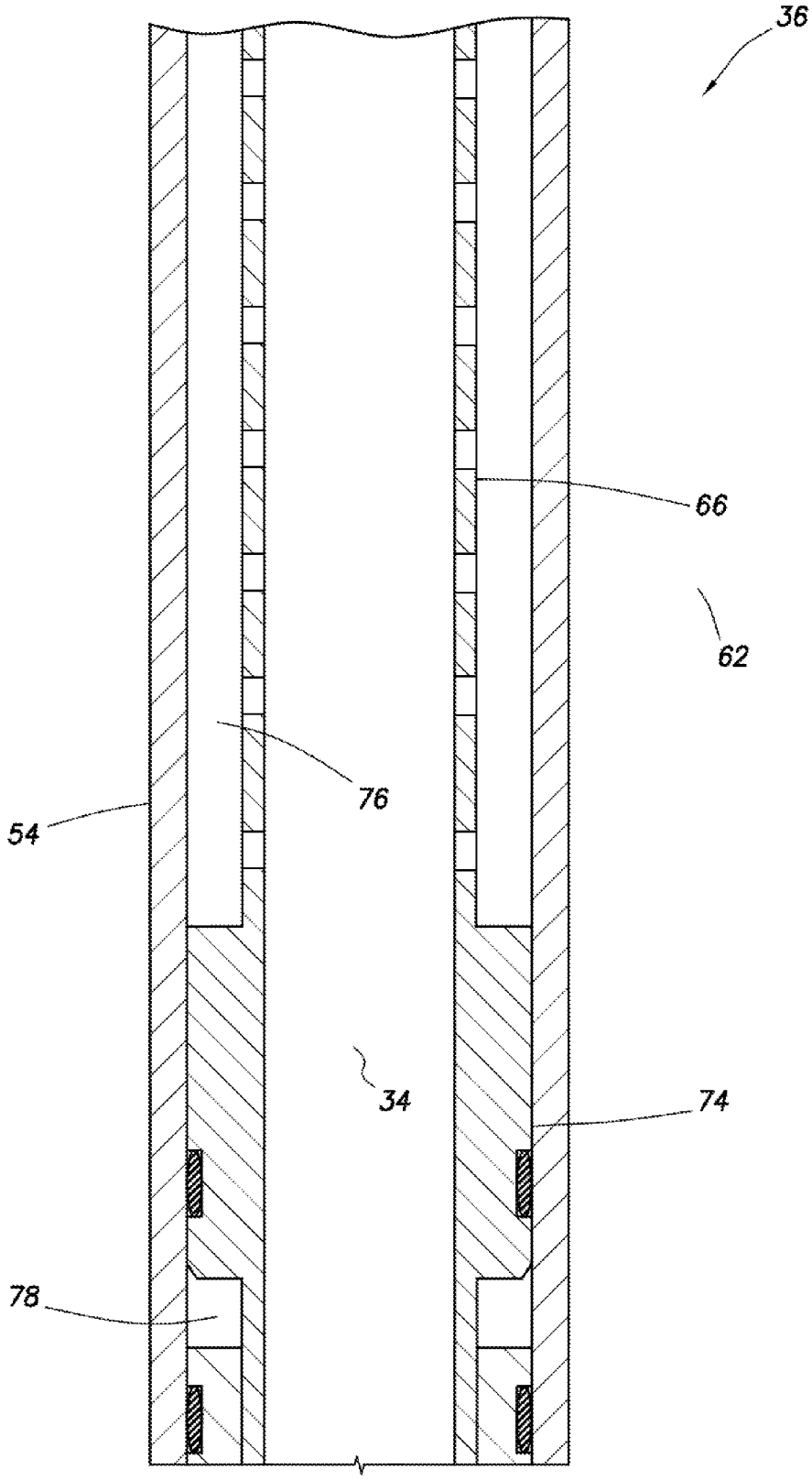
Figure 2F:
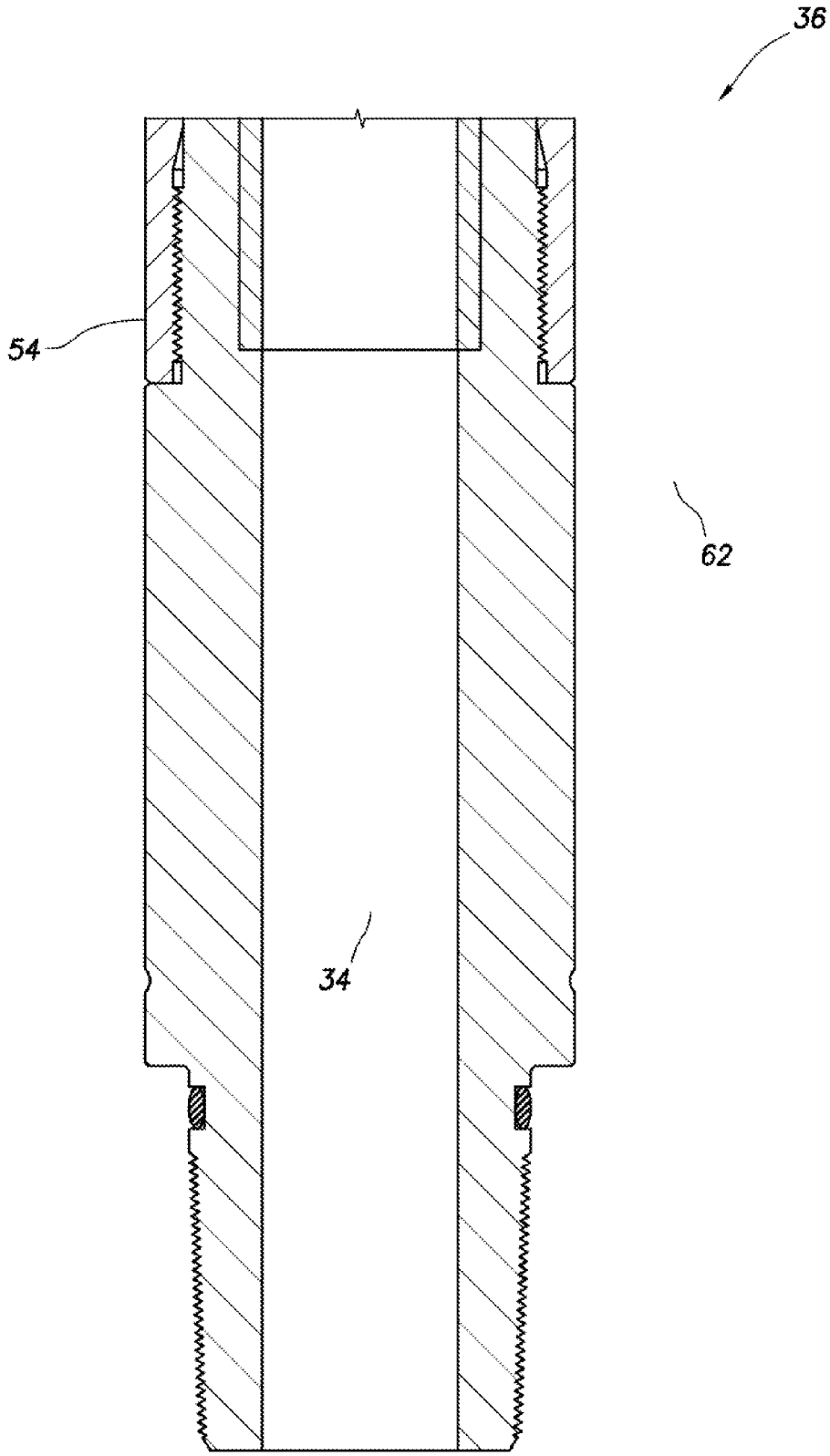

In FIG. 2E, it may be seen that a piston 74 is connected to the mandrel 68, and is reciprocably received in the housing assembly 54. The piston 74 is exposed to pressure in two chambers 76, 78 separated by the piston. The chamber 78 is exposed to pressure in the flow passage 34, and the chamber 76 is exposed to pressure in the annular area between the mandrel 68 and the housing assembly, which is also downstream of the filter 66 and in fluid communication with the bypass passages 44.

Of course, the bypass passages 44 are in fluid communication with the upper passage section 34*a*, as discussed above. Thus, the chamber 76 is indirectly in fluid communication with the upper passage section 34*a*, and the chamber 78 is in fluid communication with the lower passage section 34*b*, with the filter 66 interposed between the passage sections 34*a,b*.

If pressure in the lower passage section 34*b* increases relative to pressure in the upper passage section 34*a*, such as, if the filter 66 becomes clogged with debris, the piston 74 will be biased by the pressure differential to displace upwardly, thereby also displacing the mandrel 68 upwardly. When the piston 74 displaces upwardly a sufficient distance, both seals 70, 72 will be sealed against a blank portion of the mandrel 68, thereby preventing flow into the bypass passages 44 (as depicted in FIG. 3D).

Accordingly, the filter 66 filters the fluid 46 which flows from the lower passage section 34*b* to the upper passage section 34*a* as the tubular string 12 is being installed in the wellbore 14. However, if the filter 66 becomes clogged with debris (or for whatever reason flow through the filter is unacceptably restricted), flow through the bypass passage 44 can be conveniently prevented. Pressure tests of the tubular string 12 can still be performed, for example, by filling the tubular string from the surface prior to each test.

As depicted in FIG. 2D, a biasing device 80 (such as a spring, a compressed gas chamber, etc.) can be used to downwardly displace the mandrel 68 and filter 66, for example, if the pressure differential across the filter 66 decreases, thereby again allowing the fluid 46 to flow through the filter and into the bypass passages 44.

Referring additionally now to FIGS. 3A-F, the testing system 36 is representatively illustrated after the filter 66 and mandrel 68 have shifted upward to close off the bypass passages 44, and after the actuator 50 has been operated to open the valve 38. In this example, the tubular string 12 has been sufficiently installed in the wellbore 14, and formation tests using the tester valve 40 will follow, so it is now desired for the valve 38 to be in its open configuration.

Note that, in FIG. 3A, the rupture disk 60 has ruptured in response to a predetermined pressure being applied to the annulus 62, thereby creating a corresponding pressure differential across the rupture disk. The piston 52 has displaced upward, thereby opening the valve 38, as shown in FIG. 3B.

In FIG. 3D, it may be seen that the mandrel 68 has shifted upward, thereby preventing flow into the bypass passages 44. In this example, the biasing device 80 is not used. Instead, a retaining device 82 in the form of resilient locking collets 84 is used to prevent the mandrel 68 from displacing downward, after having displaced upward. Thus, once flow through the bypass passages 44 has been prevented by upward displacement of the mandrel 68, such flow cannot again be permitted (without retrieving the testing system 12 and resetting it), in this example.

Other suitable types of retaining devices 82 can include snap rings, latches, locking dogs, etc. The retaining device 82 can secure the mandrel 68 against further displacement, once a certain displacement has been achieved.

Note that it is not necessary for the mandrel 68 to displace upward, or for flow through the bypass passages 44 to be prevented, in operation of the testing system 36. The prevention of flow through the bypass passages 44 is preferably a contingency measure taken in the event that flow of the fluid 46 through the filter 66 is unacceptably restricted.

Although the valve 38 is depicted in the drawings as including the ball valve 48, it will be appreciated that other types of valves (e.g., flapper-type valves, gate or sleeve valves, etc.) may be used, if desired. One beneficial feature of the ball valve 48 is that it is debris-resistant, reliable and it preferably can seal against flow in either longitudinal direction through the flow passage 34. This latter feature can be especially beneficial if a floating rig is used to convey the tubular string 12 into the wellbore 14, since heave motion will not cause the fluid 46 to flow upwardly through the ball valve 48.

The check valves 64 can have biasing devices 86 (e.g., in the manner of a relief valve, see FIGS. 2C & 3C), so that the check valves open when a predetermined pressure differential is created from the passage section 34*b* to the passage section 34*a*. This pressure differential can be selected so that, for a certain density of the fluid 46, a corresponding certain difference in depth of the fluid in the passage 34 and annulus 62 produces that pressure differential.

For example, the biasing devices 86 could be set so that, as the tubular string 12 is being lowered in the wellbore 14, a consistent difference in depth of the fluid 46 is maintained between the passage 34 and the annulus 62. In this manner, the passage 34 will only need to be filled up that difference in depth, prior to performing a pressure test. Alternatively, pressure can be applied to the annulus 62 as needed to create the predetermined pressure differential across the check valves 64, thereby opening the check valves and filling the tubular string 12, prior to performing a pressure test.

If desired, the check valves 64 can be deactivated, thereby allowing the fluid 46 to flow from the passage section 34*a* to the passage section 34*b* through the bypass passages 44. This might be desired, for example, if pressure testing of the tubular string 12 below the valve 38 is to be performed, without opening the valve 38.

One way of accomplishing this result would be to construct the housing assembly 54 of a nonmagnetic material, at least a portion surrounding the check valves 64. A magnetic device 88 (such as, a permanent magnet, an electromagnet, a magnetostrictive material, etc., see FIG. 3B) can then be positioned in the passage 34 (for example, conveyed by wireline, coiled tubing, self-conveyed, etc.) and operated to produce a magnetic field sufficient to pull the check valves 64 off of their seats, and thereby permit reverse flow through the bypass passages 44.

In yet another optional feature, a valve (not shown) may be used to provide selective communication with the chamber 56. In this example, pressure in the chamber 58 could be increased relative to pressure in the chamber 56 to open the valve 38 (e.g., to allow for pressure testing the tubular string 12 below the valve 38, to allow the seals 30 to enter the seal bore 32 without a harmful pressure differential across the seals, etc.), or pressure in the chamber 56 could be increased relative to pressure in the chamber 58 to close the valve (e.g., to allow for pressure testing the tubular string 12 above the valve 38, etc.).

It may now be fully appreciated that this disclosure provides significant advances to the art of constructing tubular string testing systems. In one example described above, the filter 66 filters the fluid 46 flowing through the bypass passages 44, thereby preventing malfunction of the valve 38 and check valves 64. In the event of an unacceptably high restriction to flow through the filter 66 (e.g., due to debris in the filter, etc.), the bypass passages 44 can be closed, and the tubular string 12 can still be pressure tested by filling the tubular string with fluid from the surface, and then applying pressure against the closed valve 38.

The above disclosure describes a tubular string testing system 36 for use with a tubular string 12 having a flow passage 34 extending longitudinally through the tubular string 12. In one example, the testing system 36 can include a valve 38 which selectively permits and prevents fluid communication between sections 34*a,b* of the flow passage 34, a bypass passage 44 which provides fluid communication between the sections 34*a,b* of the flow passage 34 when the valve 38 is closed, and a filter 66 which filters fluid 46 that flows through the bypass passage 44.

Flow through the bypass passage 44 can be prevented in response to a predetermined pressure differential being created across the filter 66. In one example, a biasing device 80 can cause flow through the bypass passage 44 to be permitted in response to a decrease in the pressure differential across the filter 66.

Flow through the bypass passage 44 can be prevented in response to increased restriction to flow through the filter 66, and/or in response to a predetermined pressure differential being created across the filter 66.

The testing system 36 can also include at least one check valve 64 which permits flow in one direction through the bypass passage 44, and prevents flow in an opposite direction through the bypass passage 44. The at least one check valve 64 may comprise multiple check valves 64 connected in series. The check valve 64 can be interconnected in the bypass passage 44 downstream of the filter 66.

The valve 38 may comprise a ball valve 48. The valve 38 when closed may prevent flow in both longitudinal directions between the flow passage sections 34*a,b* through the valve 38.

Also described above is a method of testing a tubular string 12. In one example, the method can include permitting fluid 46 to flow through a bypass passage 44 which connects sections 34*a,b* of a flow passage 34 extending longitudinally through the tubular string 12, a filter 66 filtering the fluid 46 which flows through the bypass passage 44, a valve 38 of a tubular string testing system 36 preventing flow of the fluid 46 between the sections 34*a,b* of the flow passage 34 through the valve 38, and flow through the bypass passage 44 being prevented in response to a predetermined pressure differential being created across the filter 66.

The method may also include increasing pressure in one of the flow passage sections 34*a*, while the valve 38 is closed, thereby pressure testing the tubular string 12. The pressure testing can include at least one check valve 64 of the tubular string testing system 36 preventing flow from the one of the flow passage sections 34*a* through the bypass passage 44.

The check valve(s) 64 may be positioned in a nonmagnetic portion of a housing assembly 54. The method may include operating a magnetic device 88, thereby causing the check valve(s) 64 to permit flow in both of the opposite directions through the check valve(s) 64.

It is to be understood that the various examples described above may be utilized in various orientations, such as inclined, inverted, horizontal, vertical, etc., and in various configurations, without departing from the principles of this disclosure. The embodiments illustrated in the drawings are depicted and described merely as examples of useful applications of the principles of the disclosure, which are not limited to any specific details of these embodiments.

In the above description of the representative examples, directional terms (such as "above," "below," "upper," "lower," etc.) are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore, whether the wellbore is horizontal, vertical, inclined, deviated, etc. However, it should be clearly understood that the scope of this disclosure is not limited to any particular directions described herein.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of this disclosure. Accordingly, the foregoing detailed description is to be clearly understood as being given by way of illustration and example only, the spirit and scope of the invention being limited solely by the appended claims and their equivalents.

What is claimed is:

1. A tubular string testing system for use with a tubular string having a flow passage extending longitudinally through the tubular string, the testing system comprising:

a valve which selectively permits and prevents fluid communication between sections of the flow passage;

a bypass passage which provides fluid communication between the sections of the flow passage when the valve is closed; and a filter which filters fluid that flows through the bypass passage, wherein the filter displaces in response to a predetermined pressure differential being created across the filter.

2. A tubular string testing system for use with a tubular string having a flow passage extending longitudinally through the tubular string, the testing system comprising:

a valve which selectively permits and prevents fluid communication between sections of the flow passage;

a bypass passage which provides fluid communication between the sections of the flow passage when the valve is closed;

a filter which filters fluid that flows through the bypass passage;

at least one check valve which permits flow in one direction through the bypass passage, and prevents flow in an opposite direction through the bypass passage, wherein the check valve is positioned in a nonmagnetic portion of a housing assembly; and a magnetic device which causes the check valve to permit flow in both directions through the check valve.

3. A tubular string testing system for use with a tubular string having a flow passage extending longitudinally through the tubular string, the testing system comprising:

a valve which selectively permits and prevents fluid communication between sections of the flow passage;

a bypass passage which provides fluid communication between the sections of the flow passage when the valve is closed;

a filter which filters fluid that flows through the bypass passage;

at least one check valve which permits flow in one direction through the bypass passage, and prevents flow in an opposite direction through the bypass passage; and a magnetic device which causes the check valve to permit flow in both directions through the check valve.

4. A method of testing a tubular string, the method comprising:

permitting fluid to flow through a bypass passage which connects sections of a flow passage extending longitudinally through the tubular string, a filter filtering the fluid which flows through the bypass passage;

a valve of a tubular string testing system preventing flow of the fluid between the sections of the flow passage through the valve; and flow through the bypass passage being prevented in response to a predetermined pressure differential being created across the filter, wherein the filter displaces in response to the predetermined pressure differential being created across the filter.

5. A method of testing a tubular string, the method comprising:

permitting fluid to flow through a bypass passage which connects sections of a flow passage extending longitudinally through the tubular string, a filter filtering the fluid which flows through the bypass passage;

a valve of a tubular string testing system preventing flow of the fluid between the sections of the flow passage through the valve;

flow through the bypass passage being prevented in response to a predetermined pressure differential being created across the filter;

at least one check valve permitting flow in one direction through the bypass passage, and preventing flow in an opposite direction through the bypass passage, wherein the check valve is positioned in a nonmagnetic portion of a housing assembly; and operating a magnetic device, thereby causing the check valve to permit flow in both directions through the check valve.

6. A method of testing a tubular string, the method comprising:

permitting fluid to flow through a bypass passage which connects sections of a flow passage extending longitudinally through the tubular string, a filter filtering the fluid which flows through the bypass passage;

a valve of a tubular string testing system preventing flow of the fluid between the sections of the flow passage through the valve;

flow through the bypass passage being prevented in response to a predetermined pressure differential being created across the filter;

at least one check valve permitting flow in one direction through the bypass passage, and preventing flow in an opposite direction through the bypass passage; and operating a magnetic device, thereby causing the check valve to permit flow in both directions through the check valve.

* * * * *